US008652078B2

(12) United States Patent
Lee

(10) Patent No.: US 8,652,078 B2
(45) Date of Patent: Feb. 18, 2014

(54) SHOWER HEAD WITH WATER-POWERED VIBRATING FUNCTION

(75) Inventor: Man Hon Lee, Kowloon (HK)

(73) Assignee: Brand New Technology Ltd., Kowloon (HK)

( * ) Notice: Subject to any disclaimer, the term of this patent is extended or adjusted under 35 U.S.C. 154(b) by 966 days.

(21) Appl. No.: 12/769,619

(22) Filed: Apr. 28, 2010

(65) Prior Publication Data

US 2011/0266363 A1 Nov. 3, 2011

(51) Int. Cl.
*A61H 23/04* (2006.01)

(52) U.S. Cl.
USPC ..... 601/55; 601/160; 239/102.1; 239/449

(58) Field of Classification Search
USPC ..... 601/46, 48, 49, 55, 61, 67, 69, 75, 76, 601/84, 85, 86, 88, 89, 90, 96, 97, 105, 112, 601/134, 135, 148, 154, 155, 160, 161, 601/169; 239/102.1, 381, 383, 447, 449; 4/605

See application file for complete search history.

(56) References Cited

U.S. PATENT DOCUMENTS

| | | | | |
|---|---|---|---|---|
| 4,313,432 | A * | 2/1982 | Sievers | 601/75 |
| 4,458,676 | A * | 7/1984 | Pileggi | 601/105 |
| 5,467,927 | A * | 11/1995 | Lee | 239/383 |
| 6,213,964 | B1 * | 4/2001 | Pesovic et al. | 601/160 |
| 6,843,777 | B2 * | 1/2005 | Togno | 601/55 |

* cited by examiner

*Primary Examiner* — Quang D Thanh

(57) ABSTRACT

A shower head with water-powered vibrating function wherein a diverting member is disposed in the water diversion chamber which is operable by a diverting member actuating means between a normal shower position and a massage shower position. At the normal shower position the diverting member diverts water flow received from the water diversion chamber inlet to leave the water diversion chamber through the first water diversion chamber outlet for exiting the shower head through a first water outlet; and at the massage shower position, the diverting member diverts water flow received from the water diversion chamber inlet to leave the water diversion chamber through the second water diversion chamber outlet for entering the turbine chamber for rotating the turbine and thereafter leaving the turbine chamber to exit the shower head through a second water outlet.

8 Claims, 15 Drawing Sheets

SHOWER HEAD WITH WATER-POWERED VIBRATING FUNCTION

BACKGROUND OF THE INVENTION

The present invention relates to a shower head and more particularly pertains to a shower head with water-powered vibrating function.

Shower head with massage function are widely available in the marketplace. Switch mechanisms are disposed in these shower heads for users to switch between the normal shower mode and the massage mode. However, the switch mechanisms are either inconvenient for users to operate or involves complicated structure and are therefore susceptible to a high manufacturing costs.

BRIEF SUMMARY OF THE INVENTION

In view of the aforesaid disadvantages now present in the prior art, the object of the present invention is to provide a shower head with vibrating function with a switch mechanism of simple and reasonable structure which is convenient for users to switch between a normal shower mode and a massage shower mode.

To attain this, the present invention comprises a water inlet, a water diversion chamber, a vibration generating member, a vibrating massage member and a diverting member. The water diversion chamber is disposed with a water diversion chamber inlet which receives water flow from the water inlet, a first water diversion chamber outlet and a second water diversion chamber outlet. The vibration generating member comprises a turbine chamber which receives a turbine, a turbine shaft driven to rotate by rotation of the turbine and an eccentric wheel driven to rotate by rotation of the turbine shaft, and the turbine chamber is driven to vibrate by rotation of the eccentric wheel disposed therein. The vibrating massage member is engaged with the turbine chamber and driven to vibrate by vibration of the turbine chamber. The diverting member is disposed in the water diversion chamber and is operable by a diverting member actuating means between a normal shower position and a massage shower position. At the normal shower position, the diverting member diverts water flow received from the water diversion chamber inlet to leave the water diversion chamber through the first water diversion chamber outlet for exiting the shower head through a first water outlet. At the massage shower position, the diverting member diverts water flow received from the water diversion chamber inlet to leave the water diversion chamber through the second water diversion chamber outlet for entering the turbine chamber for rotating the turbine and thereafter leaving the turbine chamber to exit the shower head through a second water outlet.

In one embodiment, the diverting member comprises a water blocking unit. The diverting member actuating means comprises a lever and a connecting rod which connects the water blocking unit to a first end of the lever. At the normal shower position, the lever is depressed at its second end, thereby lifting the first end of the lever together with the water blocking unit so that the water blocking unit blocks the second water diversion chamber outlet in a water-sealed manner. At the massage shower position, the first end of the lever is depressed, driving the water blocking unit to be depressed to block the first water diversion chamber outlet in a water-sealed manner.

In another embodiment, the water diversion chamber comprises a fixed inner plate and a rotatable diverting plate. The fixed inner plate is disposed with the water diversion chamber inlet and the second water diversion chamber outlet. The rotatable diverting plate is rotatable in relation to the fixed inner plate and disposed with the first water diversion chamber outlet and the diverting member in form of a groove having a first end and a second end which communicates with each other. The rotatable diverting plate serves as the diverting member actuating means. At the normal shower position, the rotatable diverting plate is at a position in which the groove is not in water communication with the water diversion chamber inlet and instead the water diversion chamber inlet is in water communication with the first water diversion chamber outlet. At the massage position, the rotatable diverting plate is rotated to a position in which the first end of the groove is in water communication with the water diversion chamber inlet and the second end of the groove is in water communication with the second water diversion chamber outlet.

In yet another embodiment, the diverting member comprises a water diverting plate disposed with the first water diversion chamber outlet and the second water diversion chamber outlet, and the diverting member actuating means comprises a pushrod disposed in a middle portion thereof with a first blocking member and a second blocking member, and the first blocking member and the second blocking member are each received in a base disposed with a spring which biases the first blocking member and the second blocking member to press against the water diverting plate respectively; wherein at the normal shower position, the pushrod is pushed towards a first direction, thereby moving the second blocking member to a position which corresponds to the second water diversion chamber outlet and the first blocking member to a position which does not block the first water diversion chamber outlet; the second blocking member is pushed towards and therefore blocks the second water diversion chamber outlet in a water-sealed manner by the force of the spring, therefore water received from the water diversion chamber inlet is diverted to leave the water diversion chamber through the first water diversion chamber outlet for exiting the shower head through the first water outlet; at the massage shower position, the pushrod is pushed towards a second direction which is opposite to the first direction, thereby moving the second blocking member to a position which does not block the second water diversion chamber outlet and the first blocking member to a position which corresponds to the first water diversion chamber outlet; the first blocking member is pushed towards the first water diversion chamber outlet and therefore blocks the first water diversion chamber outlet by the force of the spring in a water-sealed manner, therefore water received from the water diversion chamber inlet is diverted to leave the water diversion chamber through the second water diversion chamber outlet for entering the turbine chamber for rotating the turbine and thereafter leaving the turbine chamber to exit the shower head through the second water outlet.

In one another embodiment, the turbine chamber comprises a first turbine chamber which receives the turbine and the turbine shaft and a second turbine chamber which receives the eccentric wheel and is driven to vibrate by rotation of the eccentric wheel disposed therein, and the vibrating massage member is engaged with the second turbine chamber and driven to vibrate by vibration of the second turbine chamber. The first turbine chamber comprises a water receiving member, a turbine receiving member and a water outlet member. The second water diversion chamber outlet is connected to the water receiving member so that water leaving the water diversion chamber enters the water receiving member. The water receiving member is disposed with one or more water receiving member openings which are in water communication with the turbine receiving member. The turbine receiving member receives the turbine and is disposed with one or more turbine receiving member openings which divert water passing through the turbine receiving member to the water outlet member and a turbine shaft opening for the turbine shaft to pass through. The water outlet member is disposed with one or more water outlet member openings for diverting the water exiting from the turbine receiving member to exit the shower head through the second water outlet. Preferably, the water receiving member openings are narrow and small so as to ensure that water entering the turbine receiving member are powerful to rotate the turbine received in the turbine receiving member.

In one embodiment, the vibrating massage member is detachable from the second turbine chamber so that users may select from a range of vibrating massage members for different massage effects. The vibrating massage member is provided with a plurality of positioning hooks which are removably engaged with a positioning groove disposed at an outer surface of the second turbine chamber.

In another embodiment, the vibration generating member is in form of a detachable unit removably attached to a top end of the shower head by means of connecting means. In this case, the top end of the shower head is disposed with an end cap. The end cap is disposed with a first opening which is connected to the second water diversion chamber outlet by means of a connecting duct and a second opening which is connected to the second water outlet by means of a connecting duct. When the end cap is attached to the vibration generating member, the first opening is in water communication with a water receiving member of the turbine chamber and the second opening is in water communication with a water outlet member of the turbine chamber. This provides users with the flexibility to use the shower head with different types of vibration generating member for different massage effects. It could also be anticipated that in some embodiments, instead of the vibration generating member, the user may attach the end cap of the shower head to another cap unit with only a water duct therein to divert water receiving from the first opening to the second opening, thereby providing a shower head with no vibrating function.

DETAILED DESCRIPTION OF THE INVENTION

Figure 1:
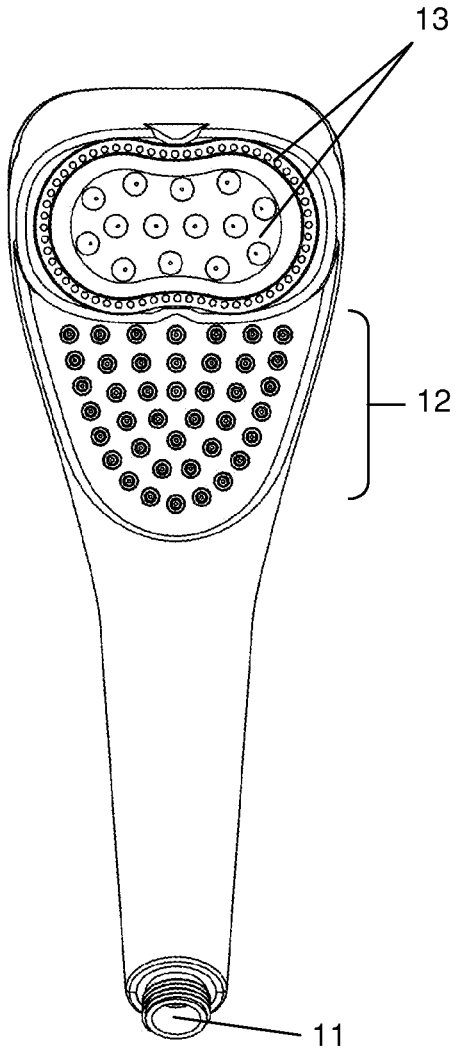
FIG. 1 is a front elevational view of the first embodiment of the present invention.
Figure 2:
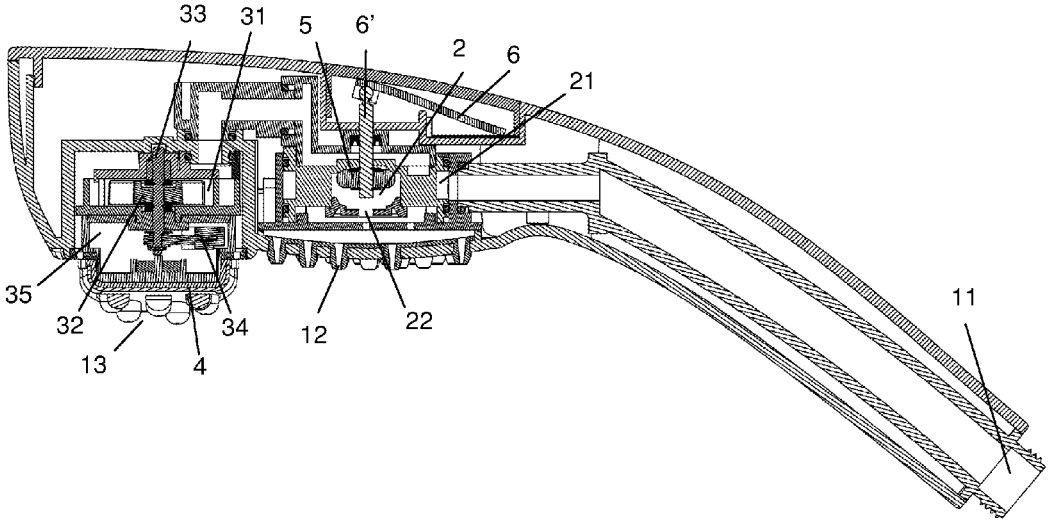
FIG. 2 is a cross sectional view of the first embodiment of the present invention at the normal shower position.
Figure 3:
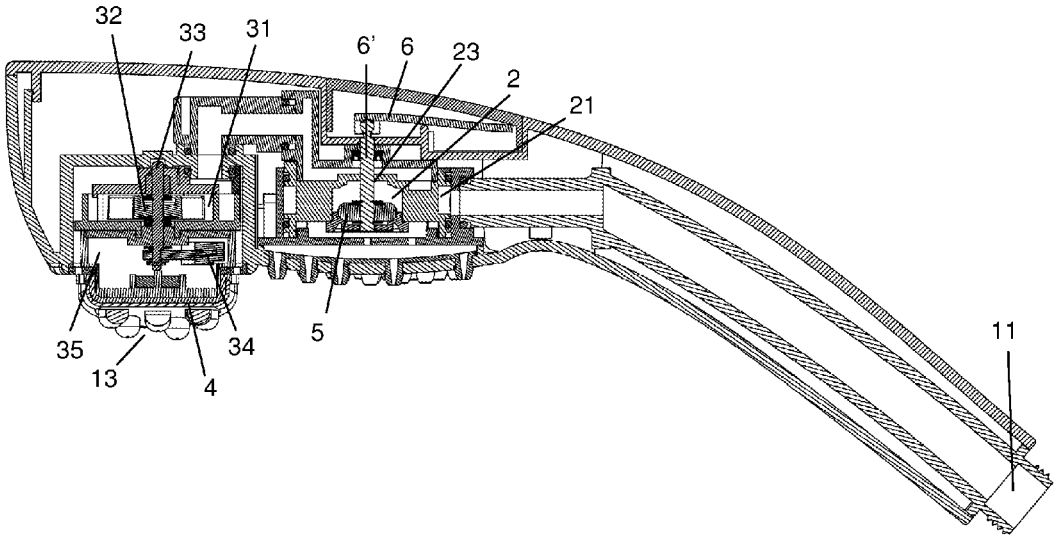
FIG. 3 is a cross sectional view of the first embodiment of the present invention at the massage shower position.
Figure 4:
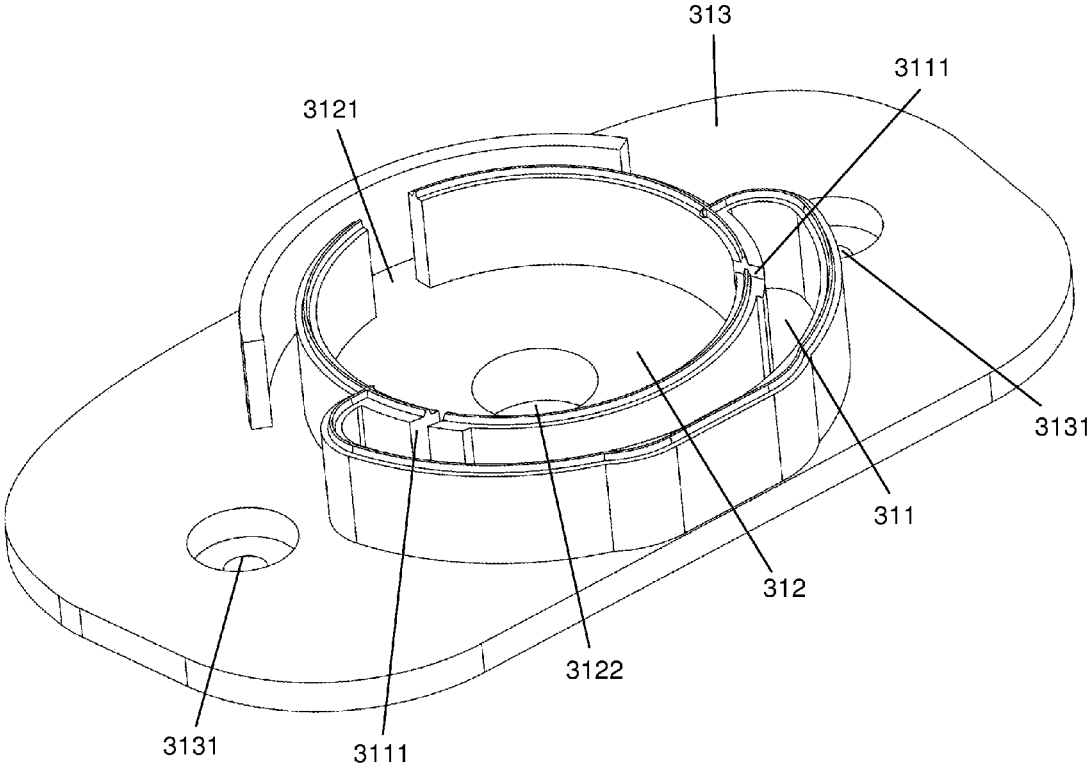
FIG. 4 is a partial perspective view of the first turbine chamber of the first embodiment of the present invention.
Figure 5:
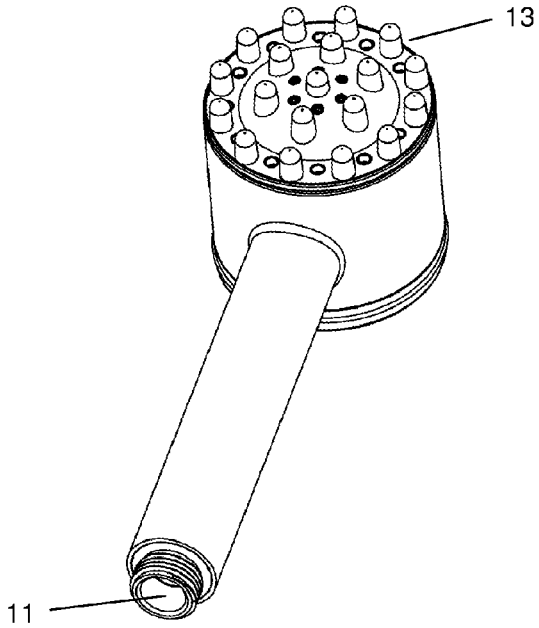
FIG. 5 is a perspective view of the second embodiment of the present invention.
Figure 6:
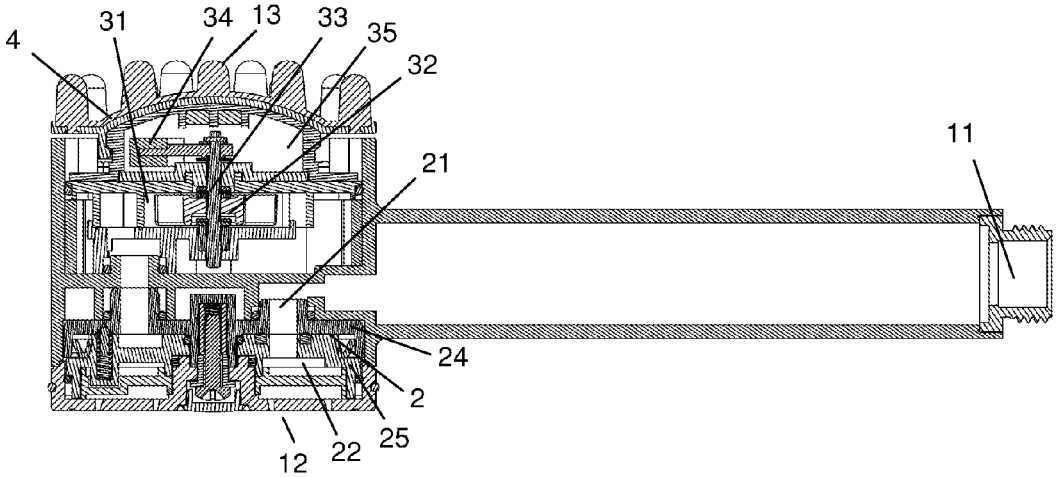
FIG. 6 is a cross sectional view of the second embodiment of the present invention at the normal shower position.
Figure 7:
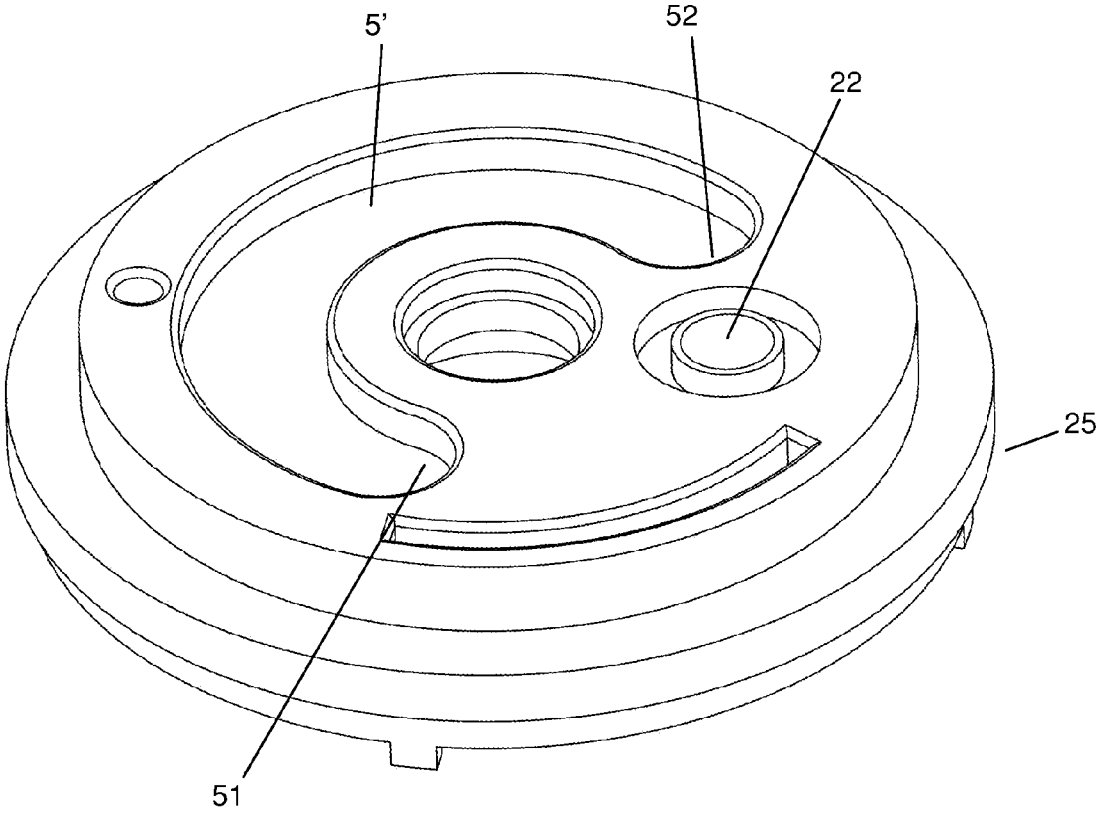
FIG. 7 is a perspective view of the rotatable diverting plate of the second embodiment of the present invention.
Figure 8:
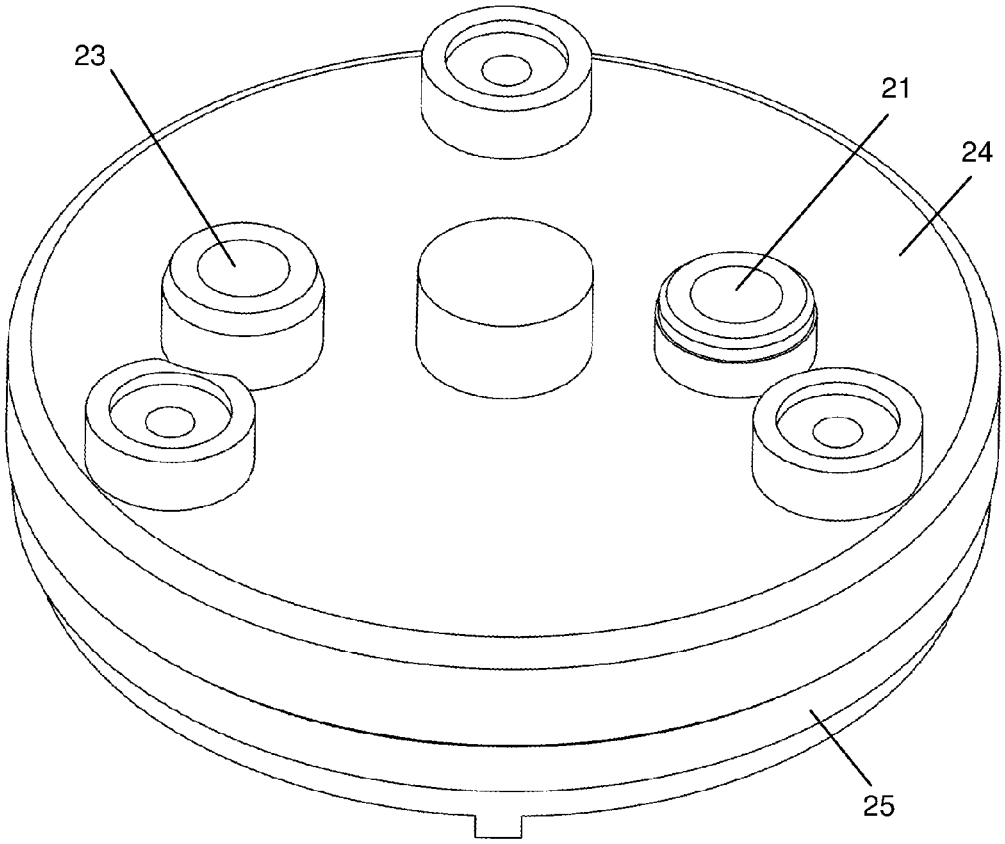
FIG. 8 is a perspective view of the fixed inner plate and the rotatable diverting plate of the second embodiment of the present invention.
Figure 9:
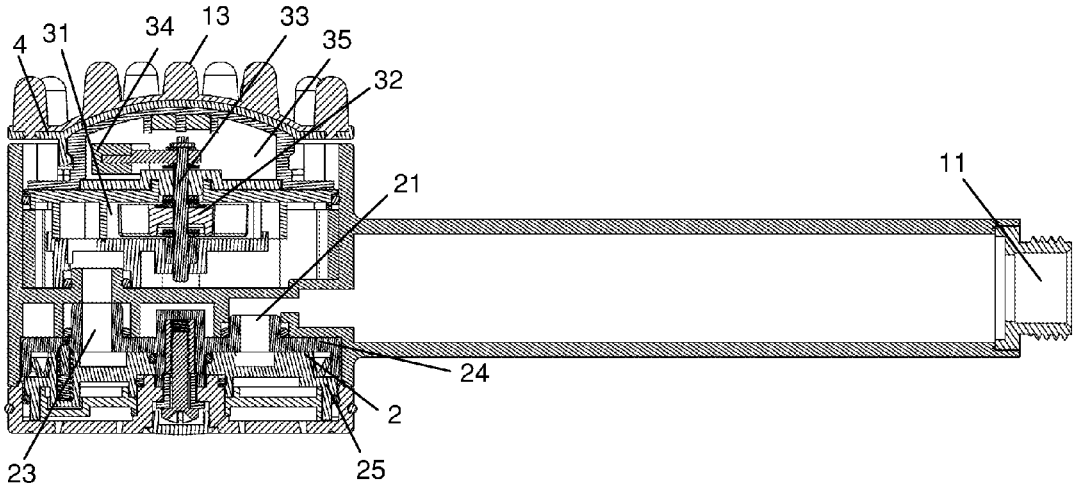
FIG. 9 is a cross sectional view of the second embodiment of the present invention at the massage shower position.
Figure 10:
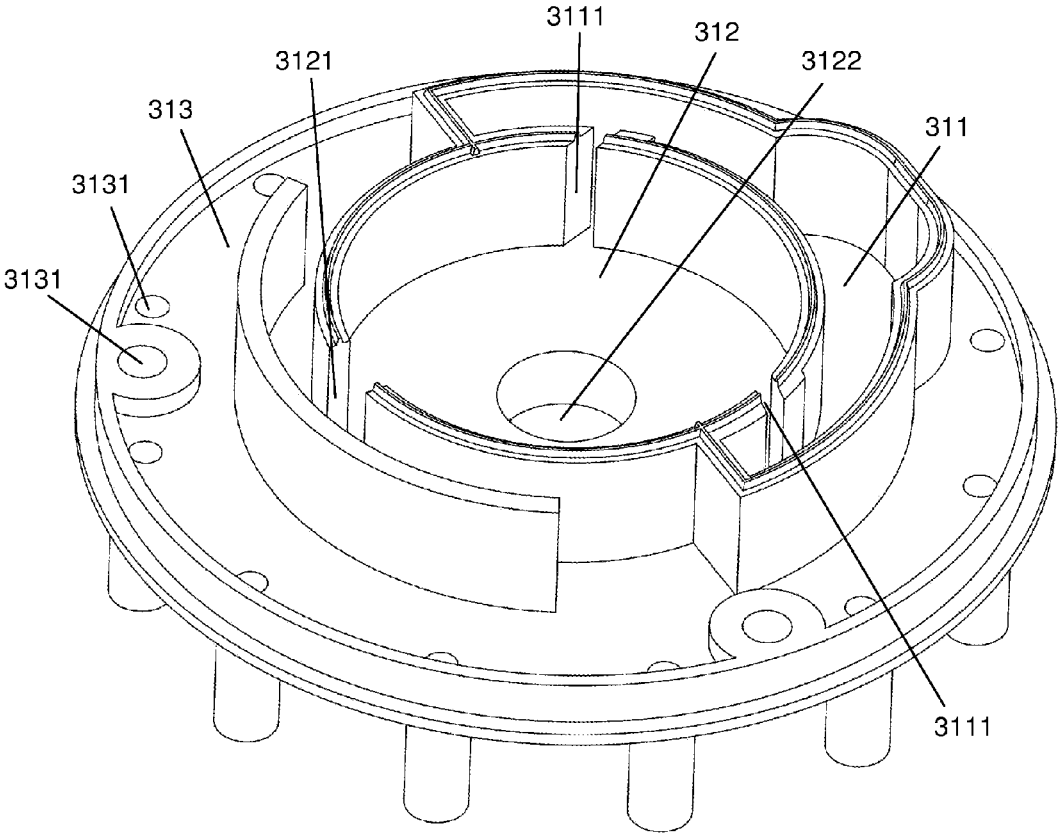
FIG. 10 is a partial perspective view of the first turbine chamber of the second embodiment of the present invention.
Figure 11:
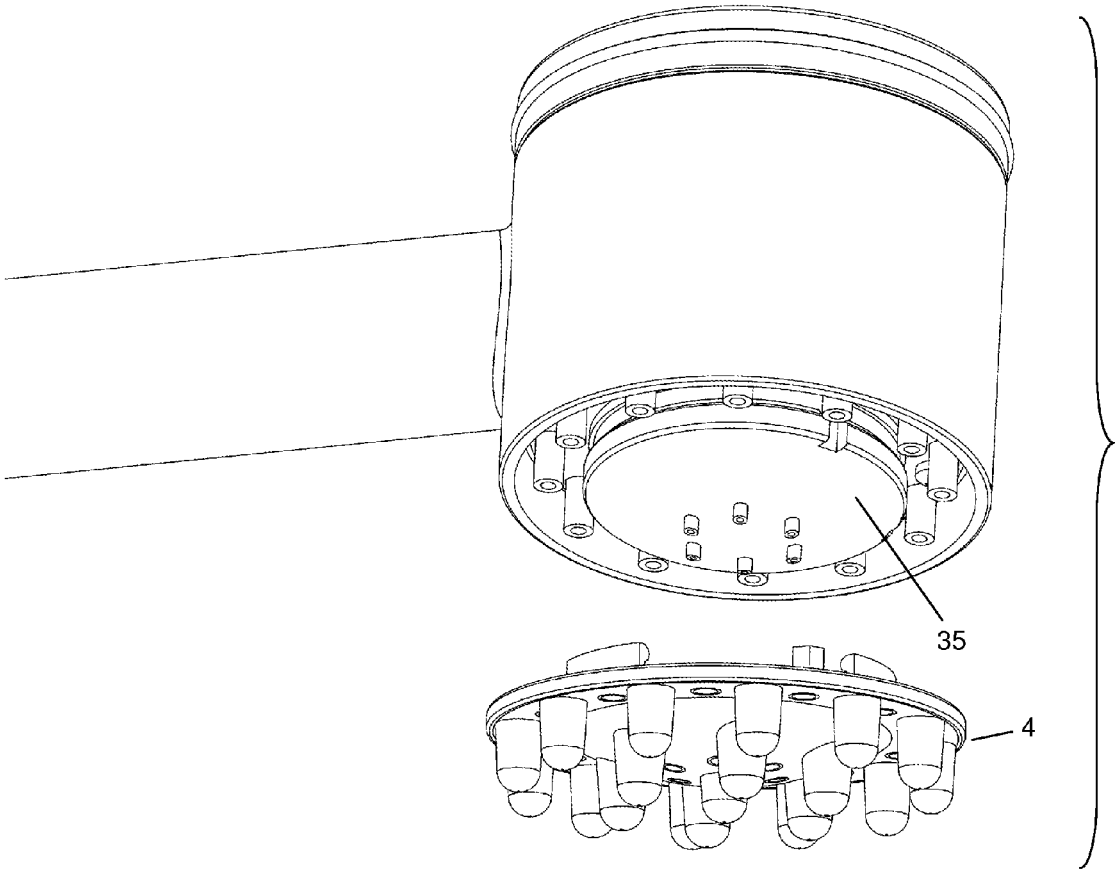
FIG. 11 is a partial perspective view of the vibrating massage member and the second turbine chamber of the second embodiment of the present invention.
Figure 12:
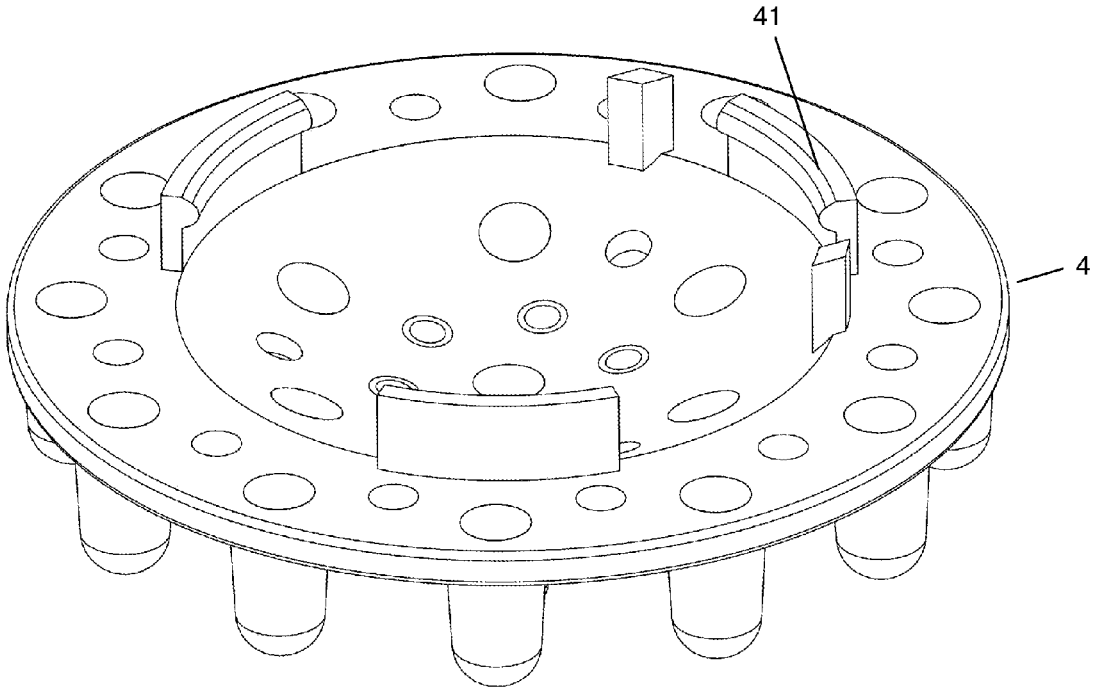
FIG. 12 is a perspective view of the vibrating massage member of the second embodiment of the present invention.
Figure 13:
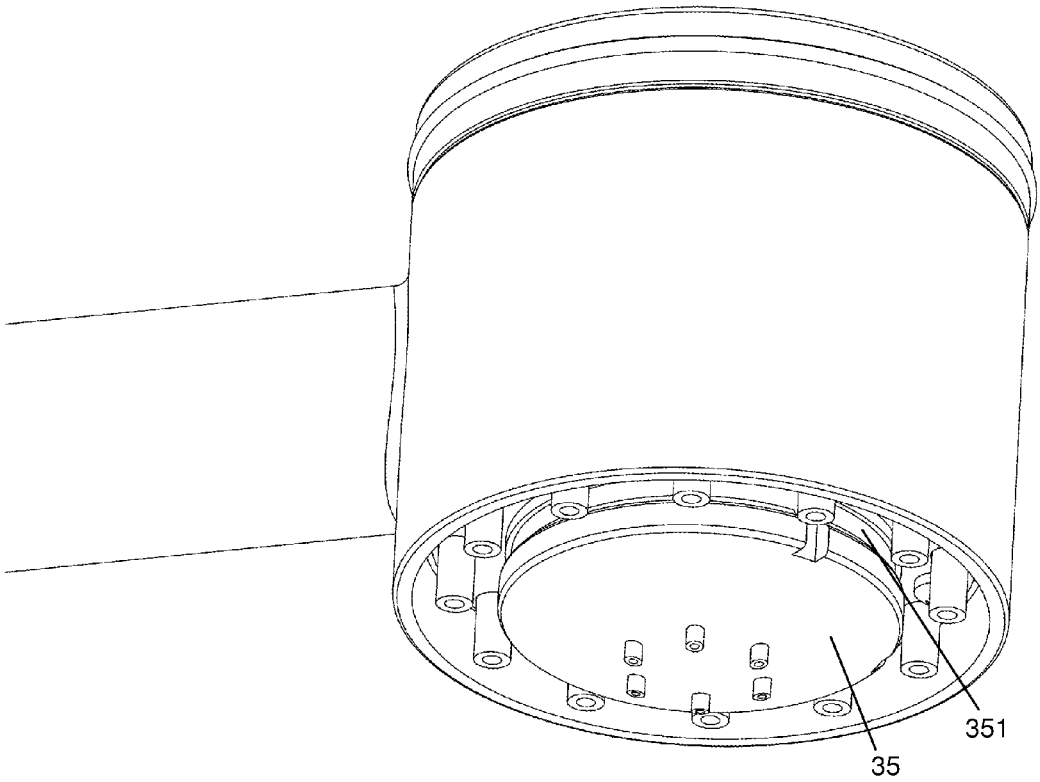
FIG. 13 is a partial perspective view of the second turbine chamber of the second embodiment of the present invention.
Figure 14:
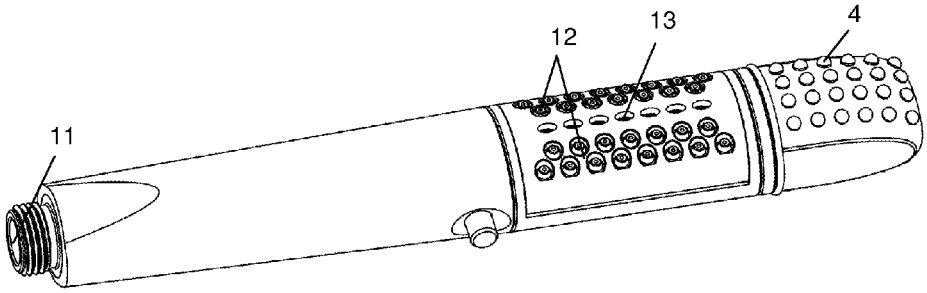
FIG. 14 is a perspective view of the third embodiment of the present invention.
Figure 15:
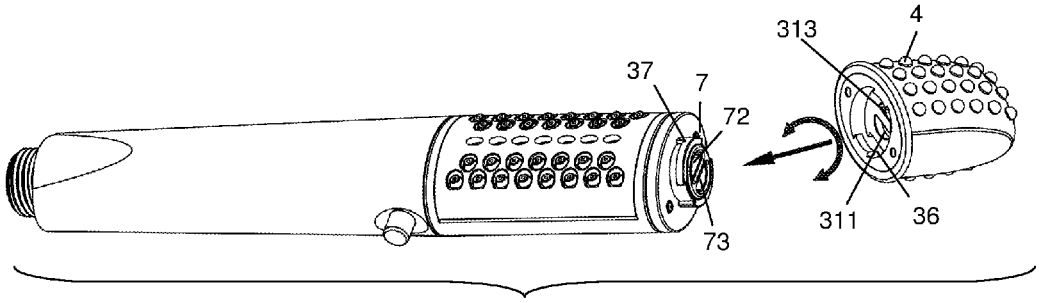
FIG. 15 is a perspective view of the third embodiment of the present invention with the vibration generating member disengaged therefrom.

The present invention is further described in detail with the following embodiment and the accompanying drawings.

FIGS. 1-4 illustrate the first embodiment of the subject invention. As illustrated, the shower head of this embodiment comprises a water inlet 11, a first water outlet 12 and a second water outlet 13. The first water outlet 12 and the second water outlet 13 are disposed at a front side of the shower head. The first water outlet 12 is disposed closer to the water inlet 11 than the second water outlet 13.

The shower head of this embodiment further comprises a water diversion chamber 2 disposed with a water diversion chamber inlet 21 which receives water flow from the water inlet 11, a first water diversion chamber outlet 22 and a second water diversion chamber outlet 23.

The shower head of this embodiment further comprises a vibration generating member which comprises a first turbine chamber 31 which receives a turbine 32, a turbine shaft 33 driven to rotate by rotation of the turbine 32, an eccentric wheel 34 driven to rotate by rotation of the turbine shaft 33, and a second turbine chamber 35 which is driven to vibrate by rotation of the eccentric wheel 34 disposed therein.

In this embodiment, the first turbine chamber 31 comprises a water receiving member 311, a turbine receiving member 312 and a water outlet member 313. The second water diversion chamber outlet 23 is connected with the water receiving member 311 so that water leaving the water diversion chamber 2 enters the water receiving member 311. The water receiving member 311 is disposed with two water receiving member openings 3111 which are in water communication with the turbine receiving member 312. The water receiving member openings 3111 are preferably narrow and small so as to ensure that water entering the turbine receiving member 312 are powerful to rotate the turbine 32 received in the turbine receiving member 312. The turbine receiving member 312 receives the turbine 32 and is disposed with one turbine receiving member opening 3121 which diverts water passing through the turbine receiving member 312 to the water outlet member 313 and a turbine shaft opening 3122 for the turbine shaft 33 to pass through. The water outlet member 313 is disposed with two water outlet member openings 3131 for diverting the water exiting from the turbine receiving member 312 to exit the shower head through the second water outlet 13.

The shower head of this embodiment further comprises a vibrating massage member 4 engaged with the second turbine chamber 35 and driven to vibrate by vibration of the second turbine chamber 35.

The shower head of this embodiment further comprises a diverting member disposed in the water diversion chamber 2 which is operable by a diverting member actuating means between a normal shower position and a massage shower position. In this embodiment, the diverting member takes the form of a water blocking unit 5 and the diverting member actuating means takes the form of a lever 6 and a connecting rod 6' which connects the water blocking unit 5 to a first end of the lever 6. At the normal shower position, the lever 6 is depressed at its second end, thereby lifting the first end of the lever 6 together with the water blocking unit 5 so that the water blocking unit 5 blocks the second water diversion chamber outlet 23 in a water-sealed manner, therefore water received from the water diversion chamber inlet 21 is diverted to leave the water diversion chamber 2 through the first water diversion chamber outlet 22 for exiting the shower head through the first water outlet 12. At the massage shower position, the first end of the lever 6 is depressed, driving the water blocking unit 5 to be depressed to block the first water diversion chamber outlet 22 in a water-sealed manner, therefore water received from the water diversion chamber inlet 21 is diverted to leave the water diversion chamber 2 through the second water diversion chamber outlet 23 for entering the first turbine chamber 31 for rotating the turbine 32 and thereafter leaving the first turbine chamber 31 to exit the shower head through the second water outlet 13.

FIGS. 5-13 illustrate the second embodiment of the subject invention. As illustrated, the shower head of this embodiment comprises a water inlet 11, a first water outlet 12 and a second water outlet 13. The first water outlet 12 is disposed at a rear side of the shower head. The second water outlet 12 is disposed at a front side of the shower head.

The shower head of this embodiment further comprises a vibration generating member which comprises a first turbine chamber 31 which receives a turbine 32, a turbine shaft 33 driven to rotate by rotation of the turbine 32, an eccentric wheel 34 driven to rotate by rotation of the turbine shaft 33, and a second turbine chamber 35 which is driven to vibrate by rotation of the eccentric wheel 34 disposed therein.

In this embodiment, the first turbine chamber 31 comprises a water receiving member 311, a turbine receiving member 312 and a water outlet member 313. The second water diversion chamber outlet 23 is connected with the water receiving member 311 so that water leaving the water diversion chamber 2 enters the water receiving member 311. The water receiving member 311 is disposed with two water receiving member openings 3111 which are in water communication with the turbine receiving member 312. The water receiving member openings 3111 are preferably narrow and small so as to ensure that water entering the turbine receiving member 312 are powerful to rotate the turbine 32 received in the turbine receiving member 312. The turbine receiving member 312 receives the turbine 32 and is disposed with one turbine receiving member opening 3121 which diverts water passing through the turbine receiving member 312 to the water outlet member 313 and a turbine shaft opening 3122 for the turbine shaft 33 to pass through. The water outlet member 313 is disposed with a plurality of water outlet member openings 3131 for diverting the water exiting from the turbine receiving member 312 to exit the shower head through the second water outlet 13.

The shower head of this embodiment further comprises a vibrating massage member 4 engaged with the second turbine chamber 35 and driven to vibrate by vibration of the second turbine chamber 35.

In this embodiment, the water diversion chamber 2 comprises a fixed inner plate 24 and a rotatable diverting plate 25. The fixed inner plate 24 is disposed with a water diversion chamber inlet 21 which receives water flow from the water inlet 11 and a second water diversion chamber outlet 23. The rotatable diverting plate 25 is rotatable in relation to the fixed inner plate 24 and disposed with a first water diversion chamber outlet 22 and a diverting member in form of a groove 5' having a first end 51 and a second end 52 which communicates with each other. The diverting member is operable by a diverting member actuating means between a normal shower position and a massage shower position. The rotatable diverting plate 25 serves as the diverting member actuating means in this embodiment. At the normal shower position the rotatable diverting plate 25 is at a position in which the groove 5' is not in water communication with the water diversion chamber inlet 21 and instead the water diversion chamber inlet 21 is in water communication with the first water diversion chamber outlet 22, thereby diverting water flow received from the water diversion chamber inlet 21 to leave the water diversion chamber 2 through the first water diversion chamber outlet 22 for exiting the shower head through the first water outlet 12. At the massage position the rotatable diverting plate 25 is rotated to a position in which the first end 51 of the groove 5' is in water communication with the water diversion chamber inlet 21 and the second end 52 of the groove 5' is in water communication with the second water diversion chamber outlet 23, thereby diverting water flow received from the water diversion chamber inlet 21 to leave the water diversion chamber 2 through the second water diversion chamber outlet 23 for entering the first turbine chamber 31 for rotating the turbine 32 and thereafter leaving the first turbine chamber 31 to exit the shower head through the second water outlet 13.

In this embodiment, the vibrating massage member 4 is detachable from the second turbine chamber 35 so that users may select from a range of vibrating massage members for different massage effects. The vibrating massage member 4 is provided with a plurality of positioning hooks 41 which are removably engaged with a positioning groove 351 disposed at an outer surface of the second turbine chamber 35.

FIGS. 14-21 illustrate the third embodiment of the subject invention. As illustrated, the shower head of this embodiment comprises a water inlet 11, a first water outlet 12 and a second water outlet 13. The first water outlet 12 and the second water outlet 13 are disposed at a front side of the shower head. The second water outlet 13 is disposed in a middle portion of the shower head and the first water outlet 12 is disposed on two sides of the second water outlet 13.

The shower head of this embodiment further comprises a vibration generating member 3. The vibration generating member 3 comprises a turbine chamber 31' which receives a turbine 32, a turbine shaft 33 driven to rotate by rotation of the turbine 32 and an eccentric wheel 34 driven to rotate by rotation of the turbine shaft 33; the turbine chamber 31' is driven to vibrate by rotation of the eccentric wheel 34 disposed therein.

Figure 16:
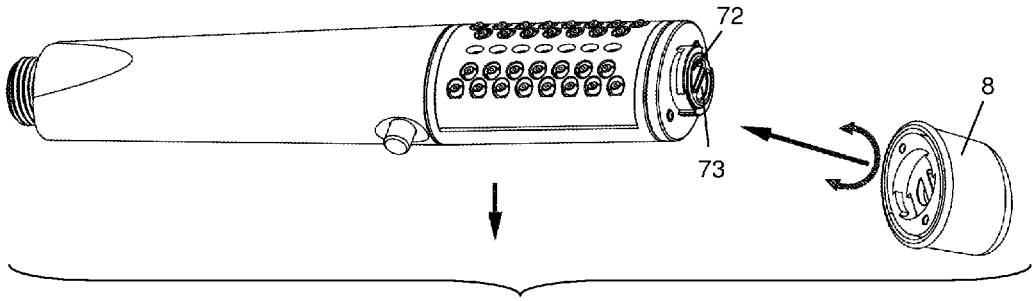
FIG. 16 is a perspective view of the third embodiment of the present invention with another cap unit disengaged therefrom.
Figure 17:
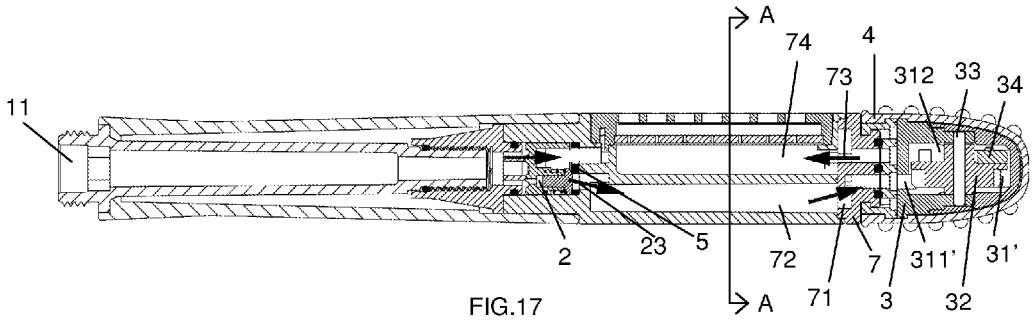
FIG. 17 is a cross sectional view of the third embodiment of the present invention at the normal shower position.
Figure 18:
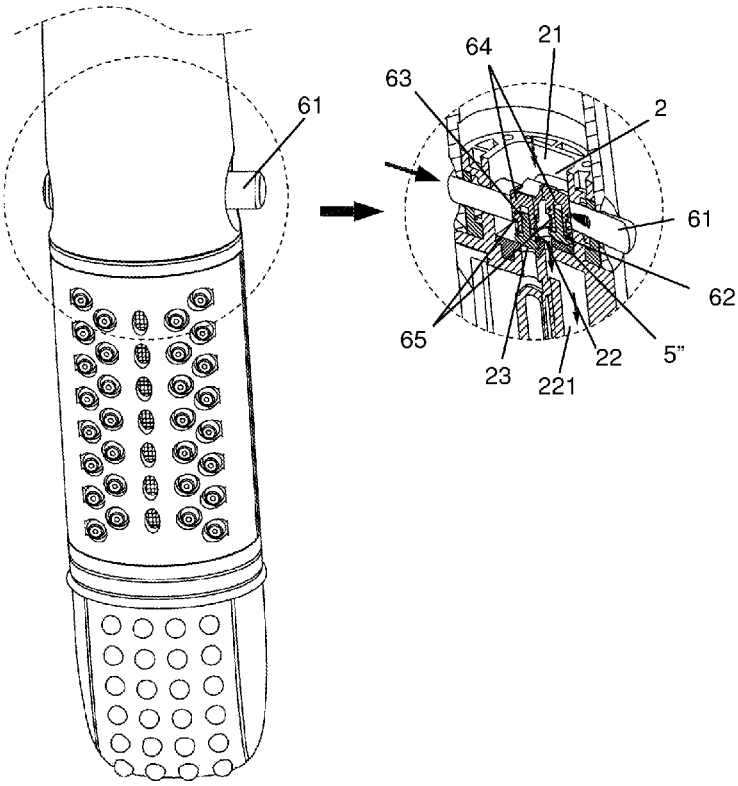
FIG. 18 is a partial enlarged view of the third embodiment of the present invention at the normal shower position.
Figure 19:
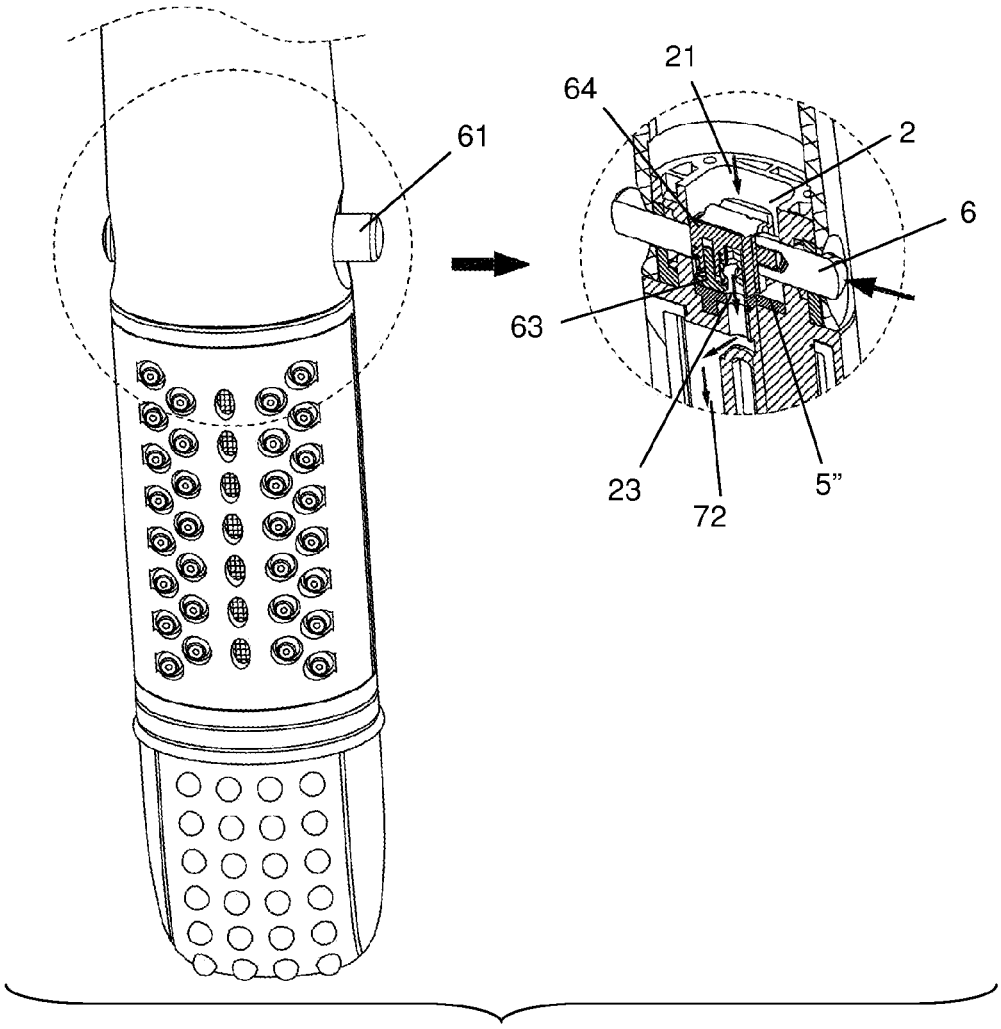
FIG. 19 is a partial enlarged view of the third embodiment of the present invention at the massage shower position.
Figure 20:
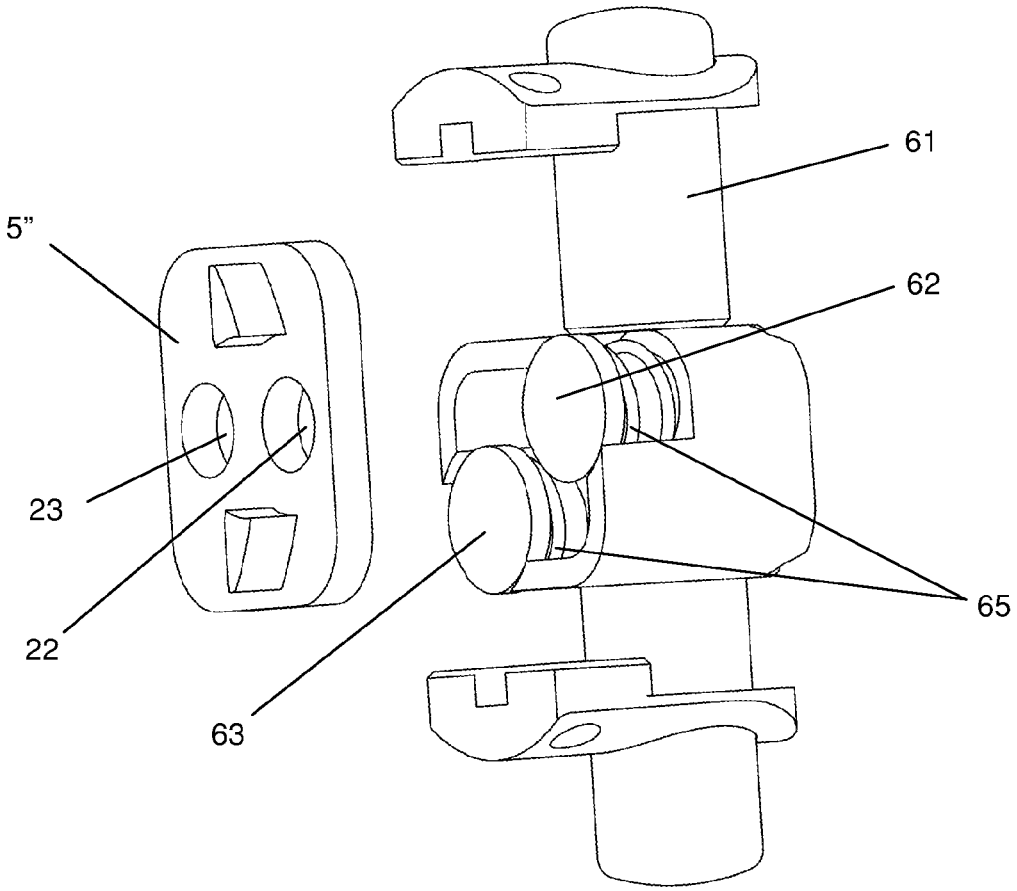
FIG. 20 is a perspective view of the diverting member and the diverting member actuating means of the third embodiment of the present invention.
Figure 21:
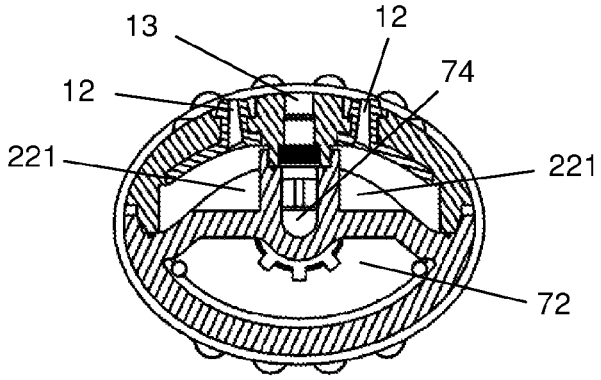
FIG. 21 is a cross sectional view of the third embodiment of the present invention illustrating the arrangement of the water ducts connecting the first water diversion chamber outlet and the second water diversion chamber outlet.

In this embodiment, the vibration generating member 3 is in form of a detachable unit removably attached to a top end of the shower head by means of connecting means commonly known in the art, in this case mounting grooves 36 and mounting protrusions 37 which are engageable with each other. The top end of the shower head is disposed with an end cap 7. The end cap 7 is disposed with a first opening 71 which is connected to the second water diversion chamber outlet 23 by means of a connecting duct 72 and a second opening 73 which is connected to the second water outlet 13 by means of a connecting duct 74. When the end cap 7 is attached to the vibration generating member 3, the first opening 71 is in water communication with a water receiving member 311' of the turbine chamber 31' so that water leaving the water diversion chamber 2 enters the water receiving member 311' and the second opening 73 is in water communication with a water outlet member 313' of the turbine chamber 31' to divert water exiting from the turbine chamber 31' to exit the shower head through the second water outlet 13. The water receiving member 311' takes the form of an opening which is preferably narrow and small so as to ensure that water entering the turbine chamber 31' are powerful to rotate the turbine 32 received in the turbine chamber 31'. In this embodiment, it could also be anticipated that as shown in FIG. 16, instead of the vibration generating member 3, the user may attach the end cap 7 of the shower head to another cap unit 8 with only a water duct therein to divert water receiving from the first opening 72 to the second opening 73, thereby providing a shower head with no vibrating function.

The shower head of this embodiment further comprises a vibrating massage member 4 engaged with the turbine chamber 31' and driven to vibrate by vibration of the turbine chamber 31'.

The shower head of this embodiment further comprises a diverting member disposed in the water diversion chamber 2 which is operable by a diverting member actuating means between a normal shower position and a massage shower position. In this embodiment, the diverting member takes the form of a water diverting plate 5" disposed with the first water diversion chamber outlet 22 and the second water diversion chamber outlet 23. The diverting member actuating means takes the form of a pushrod 61 disposed in a middle portion thereof with a first blocking member 62 and a second blocking member 63. The first blocking member 62 and the second blocking member 63 are each received in a base 64 disposed with a spring 65 which biases the first blocking member 62 and the second blocking member 63 to press against the water diverting plate 5" respectively. At the normal shower position, the pushrod 61 is pushed towards a first direction, thereby moving the second blocking member 63 to a position which corresponds to the second water diversion chamber outlet 23 and the first blocking member 62 to a position which does not block the first water diversion chamber outlet 22; the second blocking member 63 is pushed towards and therefore blocks the second water diversion chamber outlet 23 in a water-sealed manner by the force of the spring 63, therefore water received from the water diversion chamber inlet 21 is diverted to leave the water diversion chamber 2 through the first water diversion chamber outlet 22 for exiting the shower head via a connecting duct 221 through the first water outlet 12. At the massage shower position, the pushrod 61 is pushed towards a second direction which is opposite to the first direction, thereby moving the second blocking member 63 to a position which does not block the second water diversion chamber outlet 23 and the first blocking member 62 to a position which corresponds to the first water diversion chamber outlet 22; the first block member 62 is pushed towards and therefore blocks the first water diversion chamber outlet 22 by the force of the spring 63 in a water-sealed manner, therefore water received from the water diversion chamber inlet 21 is diverted to leave the water diversion chamber 2 through the second water diversion chamber outlet 23 for entering the turbine chamber 31' for rotating the turbine 32 and thereafter leaving the turbine chamber 31' to exit the shower head through the second water outlet 13.

The above embodiments are preferred embodiments of the present invention. The present invention is capable of other embodiments and is not limited by the above embodiment. Any other variation, decoration, substitution, combination or simplification, whether in substance or in principle, not deviated from the spirit of the present invention, is replacement or substitution of equivalent effect and falls within the scope of protection of the present invention.

What is claimed is:

1. A shower head with water-powered vibrating function which comprises:

a water inlet;

a water diversion chamber disposed with a water diversion chamber inlet which receives water flow from the water inlet, a first water diversion chamber outlet and a second water diversion chamber outlet;

a vibration generating member which comprises a turbine chamber which receives a turbine, a turbine shaft driven to rotate by rotation of the turbine and an eccentric wheel driven to rotate by rotation of the turbine shaft, and the turbine chamber is driven to vibrate by rotation of the eccentric wheel disposed therein, a vibrating massage member engaged with the turbine chamber and driven to vibrate by vibration of the turbine chamber; and a diverting member disposed in the water diversion chamber which is operable by a diverting member actuating means between a normal shower position and a massage shower position, wherein at the normal shower position the diverting member diverts water flow received from the water diversion chamber inlet to leave the water diversion chamber through the first water diversion chamber outlet for exiting the shower head through a first water outlet; and at the massage shower position, the diverting member diverts water flow received from the water diversion chamber inlet to leave the water diversion chamber through the second water diversion chamber outlet for entering the turbine chamber for rotating the turbine and thereafter leaving the turbine chamber to exit the shower head through a second water outlet;

the turbine chamber comprises a first turbine chamber which received the turbine and the turbine shaft and a second turbine chamber which receives the eccentric wheel and is driven to vibrate by rotation of the eccentric wheel disposed therein, and the vibrating massage member is engaged with the second turbine chamber and driven to vibrate by vibration of the second turbine chamber;

the first turbine chamber comprises a water receiving member to which the second water diversion chamber outlet is connected so that water leaving the water diversion chamber enters the water receiving member and the water receiving member is disposed with one or more water receiving member openings which are in water communication with the turbine receiving member, a turbine receiving member which receives the turbine and is disposed with one or more turbine receiving member openings which divert water passing through the turbine receiving member to the water outlet member and a turbine shaft opening for the turbine shaft to pass through, and a water outlet member which is disposed with one or more water outlet member openings for diverting the water exiting from the turbine receiving member to exit the shower head through the second water outlet.

2. The shower head with water-powered vibrating function as in claim 1, wherein the diverting member comprises a water blocking unit and the diverting member actuating means comprises a lever and a connecting rod which connects the water blocking unit to a first end of the lever; at the normal shower position, the lever is depressed at its second end, thereby lifting the first end of the lever together with the water blocking unit so that the water blocking unit blocks the second water diversion chamber outlet in a water-sealed manner; at the massage shower position, the first end of the lever is depressed, driving the water blocking unit to be depressed to block the first water diversion chamber outlet in a water-sealed manner.

3. The shower head with water-powered vibrating function as in claim 1, wherein the water diversion chamber comprises a fixed inner plate disposed with the water diversion chamber inlet and the second water diversion chamber outlet; and a rotatable diverting plate which is rotatable in relation to the fixed inner plate and disposed with the first water diversion chamber outlet and the diverting member in form of a groove having a first end and a second end which communicates with each other; and the rotatable diverting plate serves as the diverting member actuating means; wherein at the normal shower position the rotatable diverting plate is at a position in which the groove is not in water communication with the water diversion chamber inlet and instead the water diversion chamber inlet is in water communication with the first water diversion chamber outlet; at the massage position the rotatable diverting plate is rotated to a position in which the first end of the groove is in water communication with the water diversion chamber inlet and the second end of the groove is in water communication with the second water diversion chamber outlet.

4. The shower head with water-powered vibrating function as in claim 1, wherein the diverting member comprises a water diverting plate disposed with the first water diversion chamber outlet and the second water diversion chamber outlet, and the diverting member actuating means comprises a pushrod disposed in a middle portion thereof with a first blocking member and a second blocking member, and the first blocking member and the second blocking member are each received in a base disposed with a spring which biases the first blocking member and the second blocking member to press against the water diverting plate respectively; wherein at the normal shower position, the pushrod is pushed towards a first direction, thereby moving the second blocking member to a position which corresponds to the second water diversion chamber outlet and the first blocking member to a position which does not block the first water diversion chamber outlet, and the second blocking member is pushed towards and therefore blocks the second water diversion chamber outlet in a water-sealed manner by force of the spring, therefore water received from the water diversion chamber inlet is diverted to leave the water diversion chamber through the first water diversion chamber outlet for exiting the shower head through the first water outlet; at the massage shower position, the pushrod is pushed towards a second direction which is opposite to the first direction, thereby moving the second blocking member to a position which does not block the second water diversion chamber outlet and the first blocking member to a position which corresponds to the first water diversion chamber outlet, and the first block member is pushed towards and therefore blocks the first water diversion chamber outlet by force of the spring in a water-sealed manner, therefore water received from the water diversion chamber inlet is diverted to leave the water diversion chamber through the second water diversion chamber outlet for entering the turbine chamber for rotating the turbine and thereafter leaving the turbine chamber to exit the shower head through the second water outlet.

5. The shower head with water-powered vibrating function as in claim 1, wherein the water receiving member openings are narrow and small so as to ensure that water entering the turbine receiving member are powerful to rotate the turbine received in the turbine receiving member.

6. The shower head with water-powered vibrating function as in claim 1, wherein the vibrating massage member is provided with a plurality of positioning hooks which are removably engaged with a positioning groove disposed at an outer surface of the second turbine chamber.

7. The shower head with water-powered vibrating function as in claim 1, wherein the vibration generating member is in form of a detachable unit removably attached to a top end of the shower head by means of connecting means.

8. The shower head with water-powered vibrating function as in claim 7, wherein the top end of the shower head is disposed with an end cap, and the end cap is disposed with a first opening which is connected to the second water diversion chamber outlet and a second opening which is connected to the second water outlet; when the end cap is attached to the vibration generating member, the first opening is in water communication with a water receiving member of the turbine chamber and the second opening is in water communication with a water outlet member of the turbine chamber.

* * * * *